US007926137B2

(12) United States Patent
Walters-Olaru

(10) Patent No.: US 7,926,137 B2
(45) Date of Patent: Apr. 19, 2011

(54) CAN OPENER, PRESS AND LID REMOVER

(76) Inventor: Debra Walters-Olaru, Milmay, NJ (US)

( * ) Notice: Subject to any disclaimer, the term of this patent is extended or adjusted under 35 U.S.C. 154(b) by 116 days.

(21) Appl. No.: 12/382,997

(22) Filed: Mar. 27, 2009

(65) Prior Publication Data

US 2009/0276963 A1 Nov. 12, 2009

Related U.S. Application Data

(60) Provisional application No. 61/071,626, filed on May 8, 2008.

(51) Int. Cl.
*B67B 7/72* (2006.01)
*B67B 7/86* (2006.01)
*B30B 9/04* (2006.01)

(52) U.S. Cl. ..... 7/152; 7/110; 100/116; 100/289

(58) Field of Classification Search ..... 7/152, 110; 30/410, 434; 100/110, 230, 116, 289, 255
See application file for complete search history.

(56) References Cited

U.S. PATENT DOCUMENTS

| | | | | | |
|---|---|---|---|---|---|
| 1,187,118 | A * | 6/1916 | Williamson | ..... | 100/289 |
| 1,198,666 | A * | 9/1916 | Ryan | ..... | 100/116 |
| 2,826,138 | A * | 3/1958 | Pexton | ..... | 100/289 |
| 2,933,807 | A * | 4/1960 | Wendlandt | ..... | 7/152 |
| 5,295,432 | A * | 3/1994 | Keville et al. | ..... | 100/110 |
| 5,363,759 | A | 11/1994 | D'Ambrosio | | |
| 5,419,245 | A | 5/1995 | Short | | |
| 5,501,144 | A * | 3/1996 | Bryson | ..... | 100/116 |
| 5,590,590 | A | 1/1997 | Zammit | | |
| 6,088,921 | A | 7/2000 | Valento | | |
| 2006/0042480 | A1 * | 3/2006 | Blais | ..... | 100/230 |

* cited by examiner

*Primary Examiner* — Hadi Shakeri
(74) *Attorney, Agent, or Firm* — Richard C. Litman

(57) ABSTRACT

The can opener, press and lid remover is a kitchen appliance that includes a can opener, a turnkey press, a magnetic lid remover, and a spout. The can opener, press, spout and lid remover are attached to a cylindrical-receptacle provided with a closable opening adapted to receive a can of food. The receptacle has an open top, a closed bottom, and a cylindrical wall extending between the open top and the closed bottom.

4 Claims, 5 Drawing Sheets

CAN OPENER, PRESS AND LID REMOVER

CROSS-REFERENCE TO RELATED APPLICATION

This application claims the benefit of U.S. Provisional Patent Application Ser. No. 61/071,626, filed May 8, 2008.

BACKGROUND OF THE INVENTION

1. Field of the Invention

The present invention relates to appliances, and particularly to a can opener, press and lid remover for opening canned food that includes a can opener, a press, a magnetic lid remover, and a spout for removing liquids.

2. Description of the Related Art

There are solid food products, such as meats, tuna, salmon and the like, that are canned with a high content of liquid, such as water or oil and the like. This liquid is at times smelly and not desirable to remain in the food product so it is necessary to remove the liquid from the solid food during food preparation. Usually, this involves using a can opener and cutting the lid from the can. Some then hold the cut lid against the can contents with their hands. The can is inverted to let the liquid substance drain from the can. However, it has been found that because of the sharp edges, fingers get cut. Also, this procedure is messy and ineffective, especially with the old and young, because a limited amount of force can be applied, based on the hand clamping strength.

Accordingly, devices have been used that, once the can lid is cut, the can is placed in a device to press out the liquid. This also has been found to be ineffective and messy, because when the liquid substance is squeezed out, it goes all over countertops, tables and other areas where such presses are used. Additionally, once the lid has been pressed into the can, it has to be removed, and the sharp edges of the lid have been found to be hazardous.

Thus, a can opener, press and lid remover solving the aforementioned problems is desired.

SUMMARY OF THE INVENTION

The can opener, press and lid remover includes a can opener, a turnkey press, a magnetic lid remover, and a spout. The can opener, press, spout and lid remover are attached to a cylindrical receptacle provided with a closable opening adapted to receive a can of food. The receptacle has an open top, a closed bottom, and a cylindrical wall between the open top and the closed bottom.

The can opener has a lever, a driving toothed-wheel, and a cutting disk. The opener also has a manual turning knob. The driving toothed-wheel and cutting disks extend into the open top of the receptacle, and when the lever is forced down, the cutting disk pierces the lid of the can. As the manual turning knob is turned, the driving toothed-wheel turns the cutting edge as it cuts into the lid, and thus separates the lid from the can.

The turnkey press includes a rotating knob and threaded rod with a press attached. The rotating knob is turned in one direction to move the threaded rod with the press downward. Once the press meets with the lid of the can, continued turning of the rotating knob presses the lid into the can. This, in turn, causes any liquid substance in the can to exit.

Once the liquid substance is out of the can, a spout is provided for discharging the liquid substance from the receptacle. The spout protrudes perpendicularly from the open top of the receptacle, and thus facilitates removal of the liquid substance.

After the liquid substance is removed, the rotating knob is rotated in the opposite direction, moving the threaded rod with the press upwardly, out of the can. A lid remover is provided with a magnet that magnetically attaches to the lid of can. After the lid is magnetically raised to a necessary level, it can be safely removed from the lid remover and discarded.

A set of liquid tight doors is provided for removing the can. The doors have one end attached to swing away from the closed end of the receptacle when opened. When closed, the doors form part of the wall of the receptacle.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
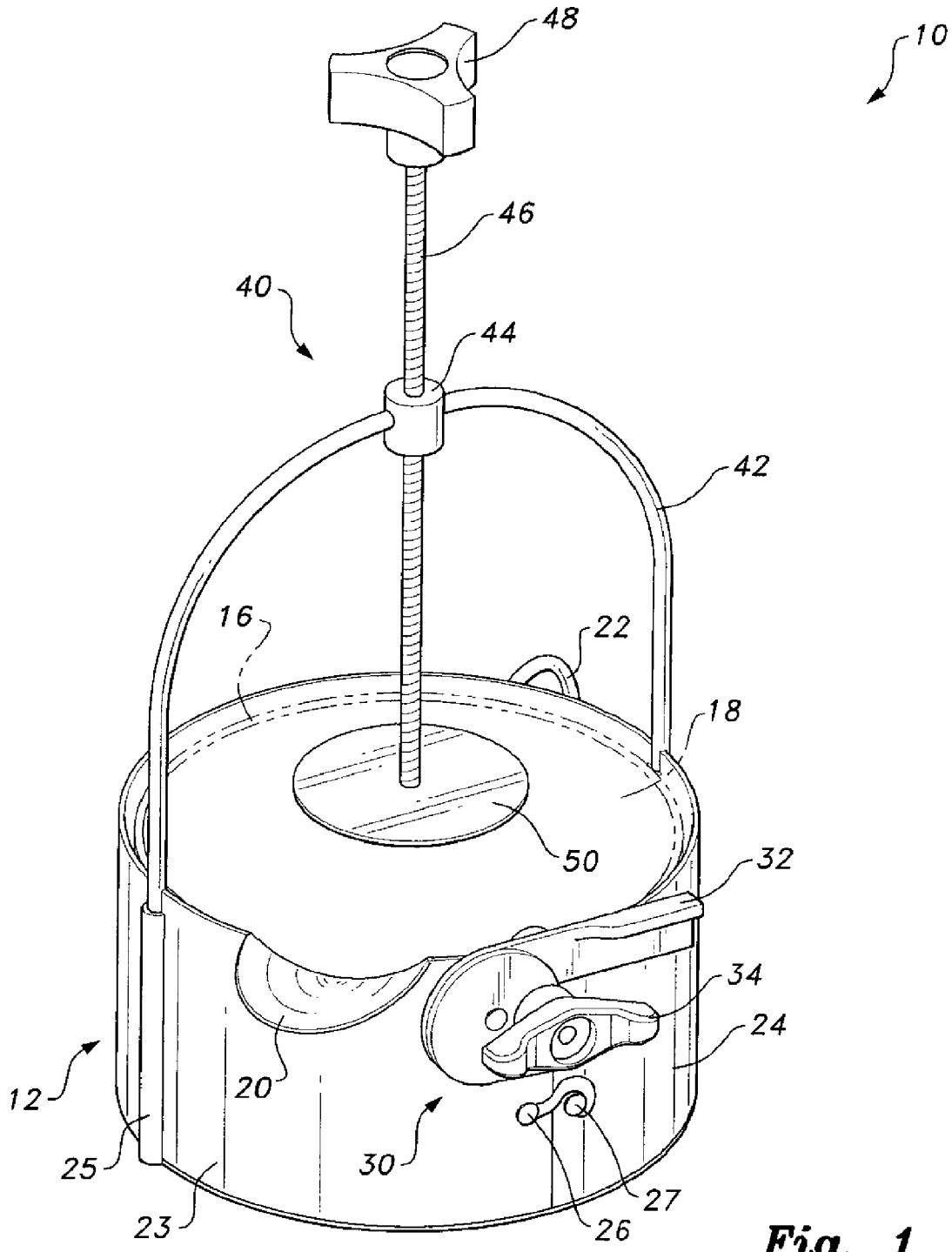
FIG. 1 is an environmental, perspective view of a can opener, press and lid remover according to the present invention.
Figure 5:
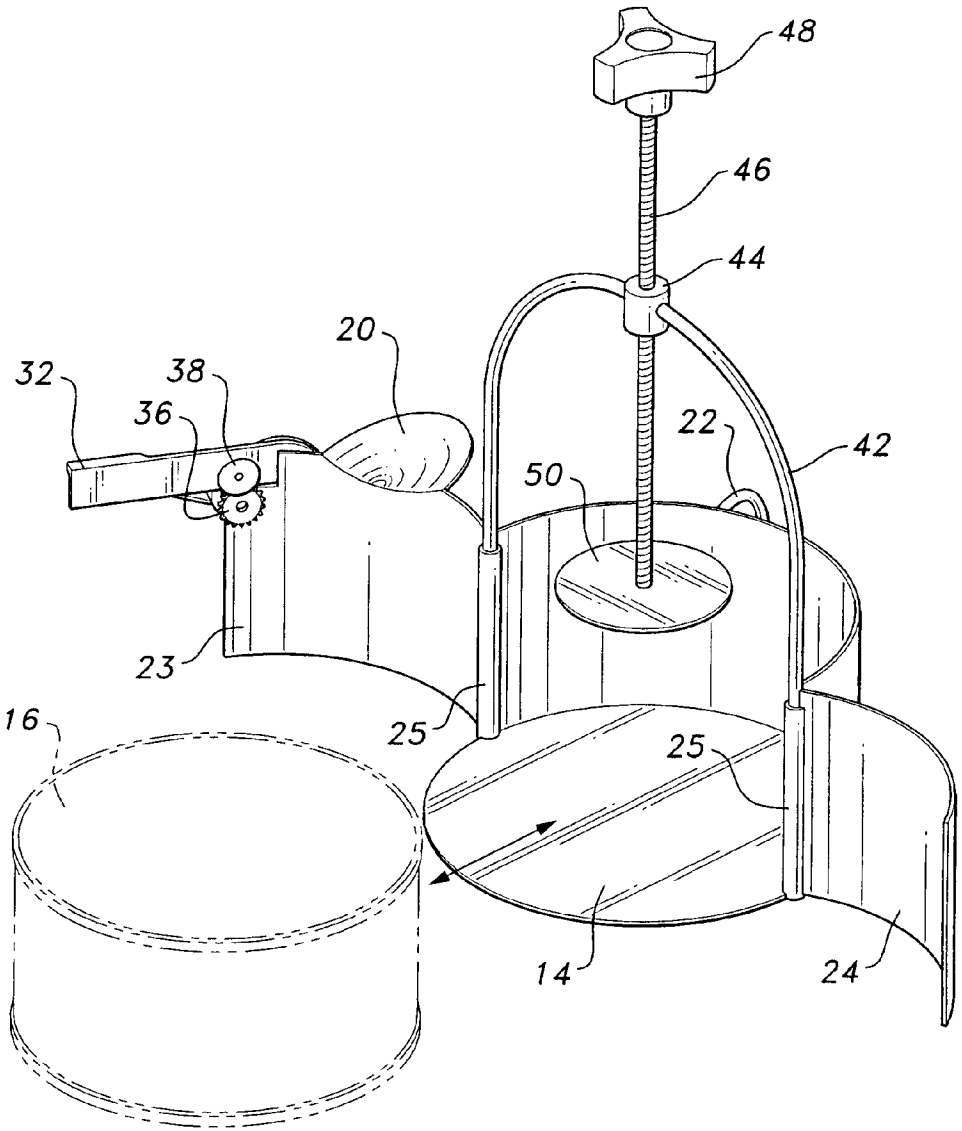
FIG. 5 an environmental, perspective view of a can opener, press and lid remover according to the present invention, shown with the doors open.

As shown in FIG. 1, the can opener, press and lid remover, generally indicated with reference number 10, includes a cylindrical receptacle 12. The receptacle 12 has an open top and a closed bottom 14, as seen in FIG. 5. The receptacle 12 is adapted to receive a can 16 having a lid 18. A spout 20 is mounted at the open top of the receptacle to permit the pouring of any liquid substance therefrom. A handle 22 is mounted on the receptacle 12. A pair of doors 23, 24 are attached to hinges 25, thereby allowing the doors 23, 24 to open and close. The doors 23, 24 include a waterproof seal that is made of rubber or other waterproofing material. The doors 23, 24 are secured in a closed position with a hook latch 26 and protruding nub 27. The hook latch 26 is mounted on door 23 and the protruding nub 27 is mounted on the other door 24. The hook latch 26 hooks over the protruding nub 27 to keep the doors 23, 24 closed when the receptacle 12 has received the can 16. Thus, the hook latch 26 and protruding nub 27 act more or less as a safety function to hold the doors 23, 24 closed prior to taking any other action with the can opener, press, and lid remover 10.

A can opener 30 is mounted above the hook latch 26 and adjacent the open top of receptacle 12. The opener 30 includes a locking lever 32, a manual turning knob 34, and a driving toothed-wheel 36, as well as a cutting wheel 38 that is best seen in FIG. 2 and will be described in more detail with respect to that figure.

The mechanism further includes a turnkey press and lid remover, generally indicated by numeral 40. The turnkey press 40 includes an arch 42 extending from the closed bottom and above the opened top of the receptacle 12. The arch 42 is held to the receptacle 12 by means of the hinges 25. In the middle of the arch 42 and situated above the opened top is a threaded bushing 44. The threaded bushing 44 receives a threaded rod 46 therein. The threaded rod 46 has two ends. At one end, above the arch 42, is a rotatable knob 48. The knob 48 is for turning the threaded rod 46 for upward or downward movement. The other end of the threaded rod 46 has a pressing member and lid remover 50 thereon.

Figure 2:
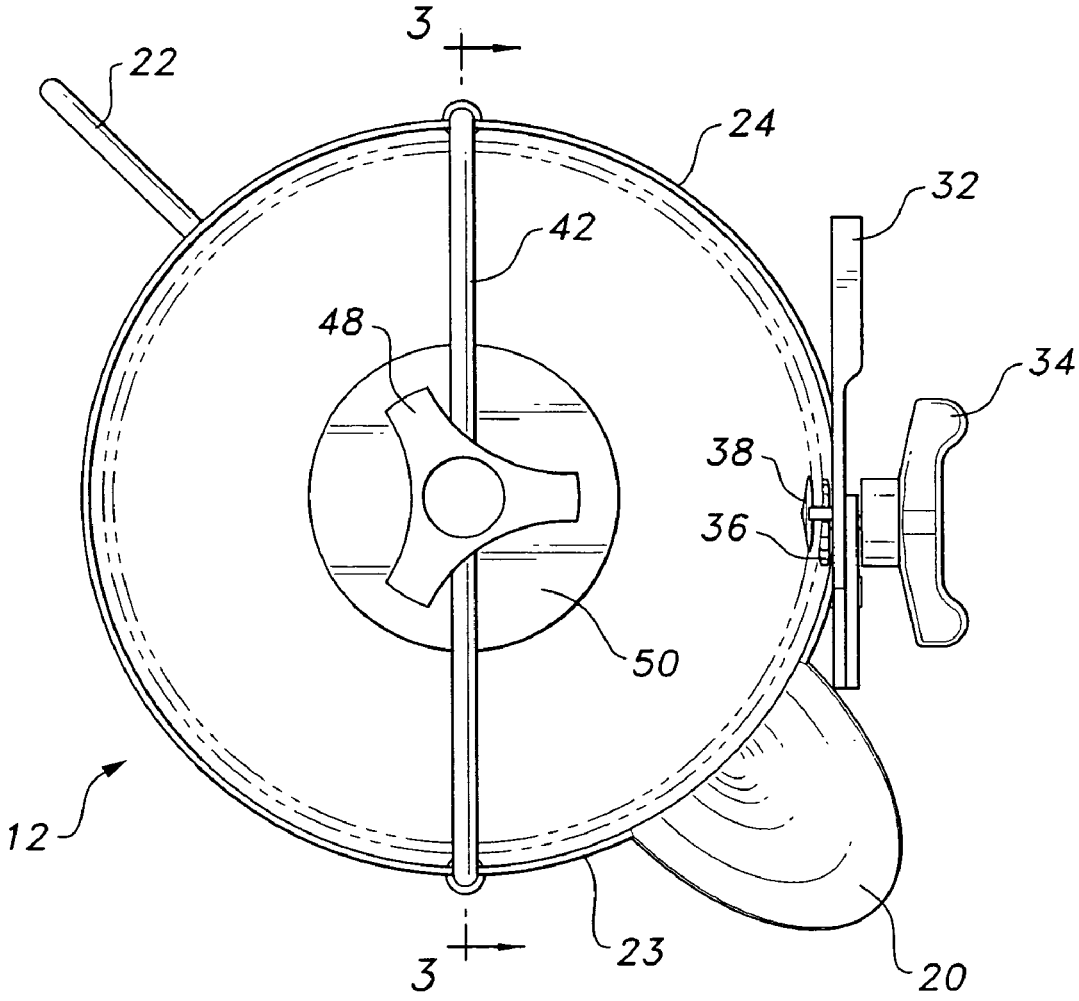
FIG. 2 is a top view of the can opener, press and lid remover of FIG. 1.

A top view of the can opener, press, and lid remover 10 is shown in FIG. 2. Looking at the can opener 30, the cutting wheel 38 can be seen cutting into the top 18 of the can 16, once the locking lever 32 is pushed down. This locking lever 32, when pushed down, also securely locks the doors 23, 24 shut to prevent any liquid substance from leaking through the doors 23, 24. At that point, the manual turning knob 34 is turned, moving the driving toothed-wheel 36. The driving wheel 36 turns the cutting wheel that then cuts into the lid 18 of the can 16, whereby the lid 18 is separated from the can 16.

Figure 3:
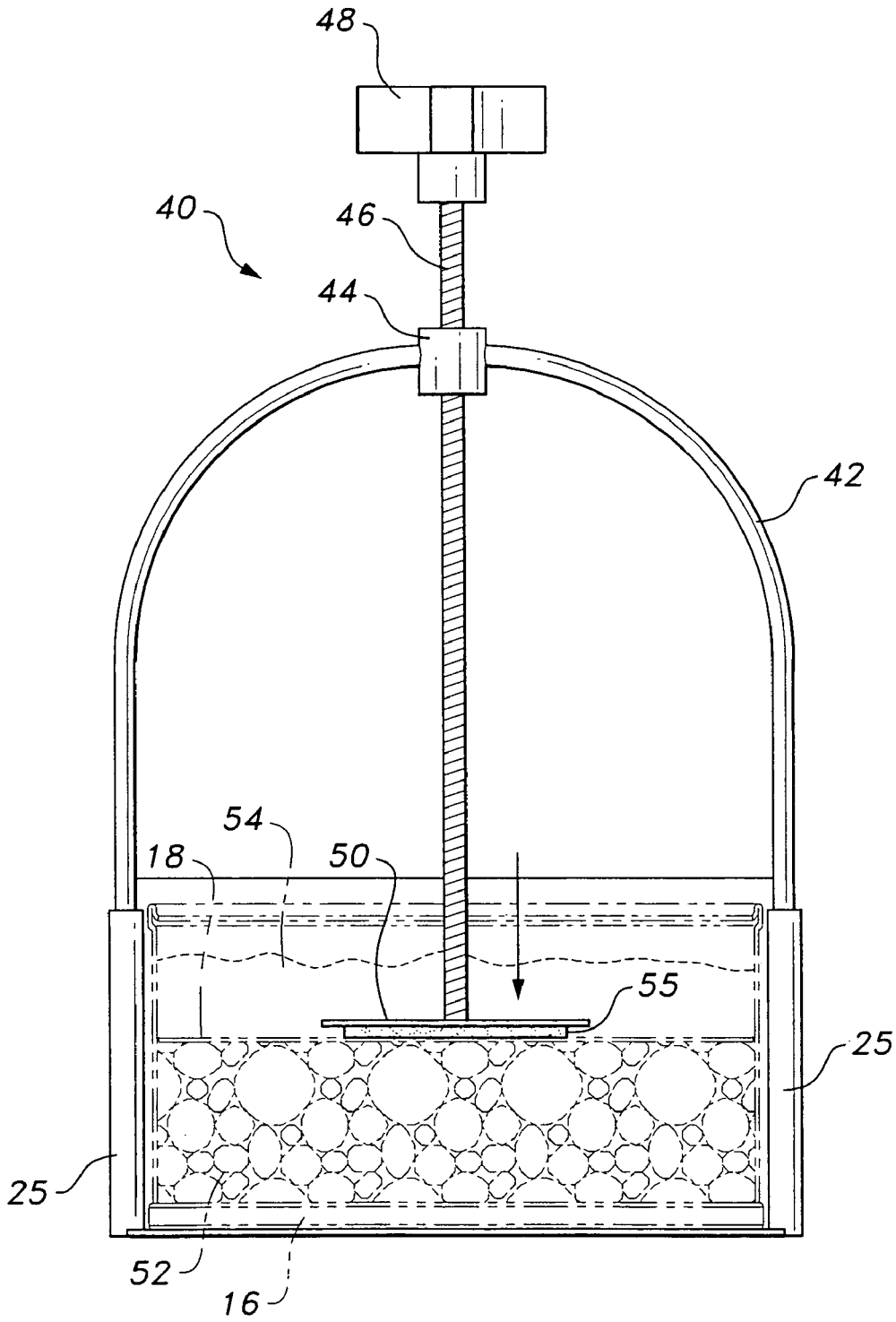
FIG. 3 is a diagrammatic environmental section view taken along lines 3-3 of FIG. 2, illustrating the magnetic press and lid remover in operation.

As seen in FIG. 3, the separated lid 18 is now used with the turnkey press 40. The rotating knob 48 is turned to push a lid remover 50 attached to the threaded rod 46 downward onto the lid 18. The lid remover 50 pushes down on the lid 18 and forces the lid 18 into the can 16. This compresses the food substance 52 into the can 16. As the food substance 52 is compressed, the liquid substance 54 is forced out of the food 52 and over the can lid 18. The liquid substance 54 settles above the lid 18, but still in the can 16. The liquid substance can now be poured out by way of the spout 20, using the handle 22 or the arch 42 to tilt the can opener, press, and lid remover 10.

Figure 4:
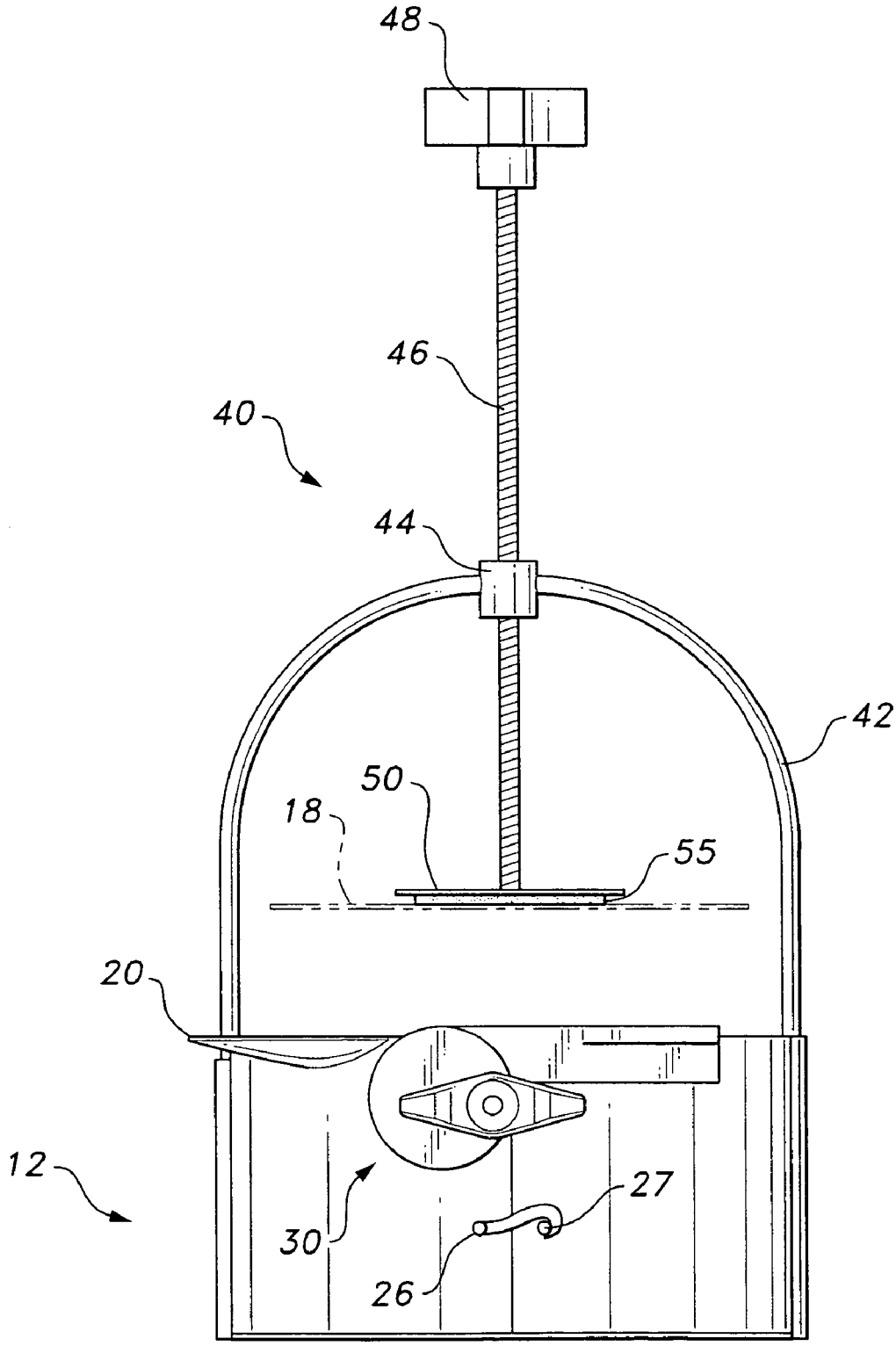
FIG. 4 is a front view of the can opener, press and lid remover of FIG. 1.

Looking at FIG. 4, the rotating knob 48 has been turned in the opposite direction to raise the pressing member and lid remover 50. The pressing member and lid remover 50 includes a magnet 55 that attracts and holds the top 18. The arch 42 acts as a safety feature by keeping the top 18 in its arch area until the lid 18 is removed and properly discarded.

FIG. 5 an environmental, perspective view of the can opener, press and lid remover 10 with the doors 23, 24 open. Once the doors 23, 24 are open, the can 16 can be either inserted or extracted. When inserted, the can 16 rests on the closed bottom 14. When extracted, the can 16 can be used without any liquid substance 54 found in the can 16. The can opener, press, and liquid remover 10 can then be safely washed and put away.

The can opener, press and lid remover 10 can be made of hard plastic or other type of suitable material, such as stainless steel, and can be of a size to accommodate conventional, standard size cans. It can be dishwasher safe, and has no parts that could injure a user.

Accordingly, it is to be understood that the present invention is not limited to the embodiments described above, but encompasses any and all embodiments within the scope of the following claims.

I claim:

1. A kitchen appliance for opening a food can, comprising:

a cylindrical receptacle adapted to receive a food can, the receptacle having an open top, a closed bottom, and a cylindrical wall extending between the open top and the closed bottom, defining a hollow interior;

a can opener mechanism for opening the food can, the can opener mechanism being mounted on the receptacle adjacent the open top, wherein said can opener mechanism includes a lever, a driving toothed-wheel and a cutting disk, the driving toothed-wheel and the cutting disk extending into the open top;

an arch extending above the top of the receptacle;

a press for pressing liquid from food in the food can, the press being mounted on the arch; and a spout for discharging liquid pressed from the food in said food can, the spout being mounted on the receptacle adjacent the open top, the spout extending outwardly from the cylindrical wall.

2. The kitchen appliance according to claim 1, wherein said press includes:

a threaded rod extending through said arch for upward and downward movement therein, the threaded rod having an upper end and a lower end;

a pressing member defining the lower end; and a rotatable knob defining the upper end.

3. The kitchen appliance according to claim 1, wherein said receptacle comprises:

a pair of doors formed in the cylindrical wall; and hinges attached to the cylindrical wall and the doors, whereby the doors can be opened and closed to access the interior of said receptacle.

4. The kitchen appliance according to claim 1, wherein said press includes:

a threaded rod extending through said arch for upward and downward movement therein, the threaded rod having an upper end and a lower end;

a pressing member defining the lower end;

a rotatable knob defining the upper end; and a magnet disposed on an undersurface of the pressing member.

* * * * *